US007859369B2

(12) United States Patent
Lias et al.

(10) Patent No.: US 7,859,369 B2
(45) Date of Patent: Dec. 28, 2010

(54) METHOD OF BI-DIRECTIONAL THERMAL CALIBRATION OF A CIRCUIT INTERRUPTER FRAME AND CIRCUIT INTERRUPTER TEST SYSTEM INCLUDING THE SAME

(75) Inventors: Edward E. Lias, Aliquippa, PA (US); Michael J. Whipple, New Sewickley Township, PA (US); Jeffrey S. Gibson, Hookstown, PA (US)

(73) Assignee: Eaton Corporation, Cleveland, OH (US)

( * ) Notice: Subject to any disclaimer, the term of this patent is extended or adjusted under 35 U.S.C. 154(b) by 386 days.

(21) Appl. No.: 12/135,711

(22) Filed: Jun. 9, 2008

(65) Prior Publication Data

US 2009/0302978 A1 Dec. 10, 2009

(51) Int. Cl.

| | |
|---|---|
| ***H01H 81/04*** | (2006.01) |
| ***H01H 75/08*** | (2006.01) |
| ***H01H 77/04*** | (2006.01) |
| ***H01H 81/02*** | (2006.01) |
| ***H01H 71/16*** | (2006.01) |
| ***H01H 61/00*** | (2006.01) |

(52) U.S. Cl. ..... 335/45; 335/42; 337/82

(58) Field of Classification Search ..... 335/42, 335/45; 337/82, 70

See application file for complete search history.

(56) References Cited

U.S. PATENT DOCUMENTS

| | | | | |
|---|---|---|---|---|
| 2,798,918 | A * | 7/1957 | Gelzheiser | 337/84 |
| 3,467,933 | A * | 9/1969 | Nystrom et al. | 337/84 |
| 3,849,747 | A * | 11/1974 | Mrenna et al. | 335/166 |
| 3,950,714 | A * | 4/1976 | Mrenna et al. | 335/35 |
| 5,008,645 | A * | 4/1991 | Mrenna | 337/70 |
| 5,317,471 | A * | 5/1994 | Izoard et al. | 361/105 |
| 5,546,060 | A * | 8/1996 | Mrenna | 335/35 |
| 5,805,038 | A | 9/1998 | Palmer et al. | |
| 6,838,961 | B2 | 1/2005 | Lias et al. | |
| 6,894,594 | B2 * | 5/2005 | Fello et al. | 335/172 |
| 6,917,267 | B2 * | 7/2005 | Lias et al. | 335/6 |
| 7,135,953 | B2 * | 11/2006 | Leitl et al. | 337/84 |

* cited by examiner

*Primary Examiner*—Anh T Mai
*Assistant Examiner*—Alexander Talpalatskiy
(74) *Attorney, Agent, or Firm*—Martin J. Moran

(57) ABSTRACT

A circuit breaker test system includes a circuit breaker under test having a deformable frame with an elongated slot, an elongated deformable portion adjacent the elongated slot and a movable portion adjacent the deformable portion, and a thermal trip assembly coupled to the movable portion. A calibration device includes a forked tool straddling the deformable portion. The trip assembly has a first thermal response. The calibration device rotates the tool in a first rotational direction and responsively deforms the deformable portion and moves the movable portion in a first direction, in order to calibrate the trip assembly for a second different thermal response. The calibration device rotates the tool in an opposite second rotational direction and responsively deforms the deformable portion and moves the movable portion in an opposite second direction, in order to re-calibrate the trip assembly for a third thermal response between the first and second thermal responses.

21 Claims, 4 Drawing Sheets

METHOD OF BI-DIRECTIONAL THERMAL CALIBRATION OF A CIRCUIT INTERRUPTER FRAME AND CIRCUIT INTERRUPTER TEST SYSTEM INCLUDING THE SAME

BACKGROUND OF THE INVENTION

1. Field of the Invention

This invention pertains generally to circuit interrupters and, more particularly, to calibration of circuit breakers including a thermal trip assembly. The invention also relates to methods of thermally calibrating circuit interrupters.

2. Background Information

Electrical switching apparatus, such as circuit interrupters, include an operating mechanism and a trip mechanism, such as a thermal trip assembly and/or a magnetic trip assembly. For example, the trip mechanism is automatically releasable to effect tripping operations and manually resettable following tripping operations.

Examples of circuit breakers including trip mechanisms are disclosed in U.S. Pat. Nos. 5,805,038 and 6,838,961, which are incorporated by reference herein. Such circuit breakers, commonly referred to as "miniature circuit breakers," have been in use for many years and their design has been refined to provide an effective, reliable circuit breaker which can be easily and economically manufactured and tested. As such, the ease of test of such circuit breakers is of importance.

As is well known, circuit breakers of this type include, for example, at least one set of separable contacts disposed within a non-conductive housing. Typically, there is a fixed contact attached to the housing and a movable contact coupled to the operating mechanism. The operating mechanism includes a movable handle that extends outside of the housing. Movement of the separable contacts is accomplished by the operating mechanism. The operating mechanism typically includes components such as the previously mentioned handle, an operating arm, upon which the movable contact is disposed, a cradle, and the trip mechanism, such as the previously mentioned thermal trip assembly and/or magnetic trip assembly. The cradle is coupled to a spring and disposed between the trip mechanism and the operating arm. The components may further include a frame to which the other components are coupled.

Referring to FIGS. 1 and 2, a circuit breaker 2 is magnetically tripped automatically, and instantaneously, in response to overload currents above a predetermined value higher than a first predetermined value for a thermal trip. Flow of overload current above a second, higher predetermined value through a bimetal 4 induces magnetic flux around such bimetal. This flux is concentrated by a magnetic yoke 6 toward an armature 8. An overload current above the higher predetermined value generates a magnetic force of such a strength that the armature 8 is attracted toward the magnetic yoke 6 resulting in the flexing of a spring 10 permitting the armature 8 to move to the right (with respect to FIGS. 1 and 2) to release a cradle 11 (partially shown in phantom line drawing) and trip the circuit breaker 2 open in the same manner as will be discussed below in connection with a thermal tripping operation.

Typically, a circuit interrupter, such as the circuit breaker 2, which includes a thermal trip assembly such as bimetal assembly 22, prior to thermal calibration has a relatively high thermal response (i.e., it takes relatively longer to trip). Still referring to FIGS. 1 and 2, during thermal calibration, a flat bit 12 from a circuit breaker calibration machine 14 (shown in block form) enters circuit breaker frame 16 through a slot 18 therein. The flat bit 12 is rotated clockwise (with respect to FIG. 2), thereby deforming the frame 16, as shown. The result is that the thermal trip time is reduced to a desired time (e.g., within a range of suitable time limits).

For example, the starting angle 20 of the bimetal assembly 22 is, for example and without limitation, 8.7° before calibration. As the flat bit 12 enters the calibration slot 18 in the frame 16 and begins to turn clockwise (with respect to FIG. 2), the upper right (with respect to FIG. 2) portion 24 of the frame 16 is deformed left and counterclockwise (with respect to FIG. 2). The geometry of the frame 16 is such that relatively thin sections 26,28 are designed into the frame 16, in order that the force, which is applied by the flat bit 12 to the right side 30 of the calibration slot 18 effectively decreases the starting angle 20 (FIG. 1) to the angle 20' of FIG. 2, thereby rotating the bimetal assembly 22 counterclockwise (with respect to FIG. 2). This frame deformation decreases the starting angle 20 (FIG. 1) of the bimetal assembly 22 and lowers the thermal calibration of the circuit breaker 2.

In particular, the flat bit 12 deforms the upper right portion 24 of the frame 16 to the left (with respect to FIG. 2) and pivots the bimetal 4 (and the armature 8) in the opposite counterclockwise direction 31 (with respect to FIG. 2). This causes the circuit breaker 2 to trip at relatively lower bimetal temperatures (i.e., lowers the $I^2R$ thermal calibration of the circuit breaker 2). The construction of the bimetal 4 is such that the low expansion side is on the right side (with respect to FIG. 2). As the bimetal 4 heats up, it starts to deflect and pull the latching surface 32 of the armature 8 toward a tripping condition in the counterclockwise direction 31 (with respect to FIG. 2). Decreasing the starting angle 20 (FIG. 1) of the bimetal 4 during calibration effectively reduces the deflection (i.e., the amount of heat) of the bimetal 4 needed to pull the latching surface 32 of the armature 8 from under the latching surface (not shown) of the cradle 11.

When the circuit breaker 2 is closed, a persistent overload current of a predetermined value causes the bimetal 4 to become heated and deflect to the right (with respect to FIGS. 1 and 2), in order to effect a time delayed thermal tripping operation. The armature 8, which is supported on the bimetal 4 by the leaf spring 10, is carried to the right with the bimetal 4 to release the cradle 11 and trip the circuit breaker 2 in a well known manner.

There is room for improvement in methods of thermally calibrating circuit interrupters.

There is also room for improvement in circuit interrupter test systems.

SUMMARY OF THE INVENTION

These needs and others are met by embodiments of the invention, which provide for bi-directional adjustment of the circuit interrupter frame, in order to calibrate the thermal trip assembly for a subsequent thermal response, which is different than an initial thermal response, and to re-calibrate the thermal trip assembly for another thermal response, which is between the initial and subsequent thermal responses.

As one aspect of the invention, a method of thermally calibrating a circuit interrupter comprises: employing a circuit interrupter under test; including with the circuit interrupter under test a deformable frame having an elongated slot, an elongated deformable portion adjacent the elongated slot and a movable portion adjacent the elongated deformable portion; coupling a thermal trip assembly to the movable portion of the deformable frame; employing the thermal trip assembly having a first thermal response; straddling the elongated deformable portion of the deformable frame with a tool; rotating the tool in a first rotational direction and responsively deforming the elongated deformable portion and moving the movable portion of the deformable frame in a first direction, in order to calibrate the thermal trip assembly for a second thermal response, which is different than the first thermal response; and rotating the tool in a second rotational direction, which is opposite the first rotational direction, and responsively deforming the elongated deformable portion and moving the movable portion of the deformable frame in a second direction, which is opposite the first direction, in order to re-calibrate the thermal trip assembly for a third thermal response, which is between the first and second thermal responses.

The method may further comprise including with the elongated deformable portion a first side and an opposite second side; and employing as the tool a forked bit having a first fork member adjacent the first side of the elongated deformable portion and an opposite second fork member adjacent the opposite second side of the elongated deformable portion.

The method may also comprise employing as the opposite second side of the elongated deformable portion an outer edge of the deformable frame; disposing the elongated deformable portion between the elongated slot and the outer edge; disposing the first fork member in the elongated slot; and disposing the opposite second fork member adjacent the outer edge of the deformable frame.

As another aspect of the invention, a circuit interrupter test system comprises: a circuit interrupter under test, the circuit interrupter under test comprising: a deformable frame including an elongated slot, an elongated deformable portion adjacent the elongated slot and a movable portion adjacent the elongated deformable portion, and a thermal trip assembly coupled to the movable portion of the deformable frame; and a calibration device comprising: a tool straddling the elongated deformable portion of the deformable frame, wherein the thermal trip assembly has a first thermal response, wherein the calibration device is structured to rotate the tool in a first rotational direction and responsively deform the elongated deformable portion and move the movable portion of the deformable frame in a first direction, in order to calibrate the thermal trip assembly for a second thermal response, which is different than the first thermal response, and wherein the calibration device is structured to rotate the tool in a second rotational direction, which is opposite the first rotational direction, and responsively deform the elongated deformable portion and move the movable portion of the deformable frame in a second direction, which is opposite the first direction, in order to re-calibrate the thermal trip assembly for a third thermal response, which is between the first and second thermal responses.

The elongated deformable portion may include a first side and an opposite second side; and the tool may include a forked bit having a first fork member adjacent the first side of the elongated deformable portion and an opposite second fork member adjacent the opposite second side of the elongated deformable portion.

The opposite second side of the elongated deformable portion may be an outer edge of the deformable frame; the elongated deformable portion may be between the elongated slot and the outer edge; the first fork member may be in the elongated slot; and the opposite second fork member may be adjacent the outer edge.

The calibration device may further comprise a calibration apparatus structured to rotate the tool.

The opposite second side of the elongated deformable portion may be an outer edge; the thermal trip assembly may be a bimetal disposed at a first angle for the first thermal response; the second thermal response may correspond to a second angle, which is less than the first angle; and the third thermal response may correspond to a third angle, which is less than the first angle and greater than the second angle.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "straddle" and variations thereof shall mean "astride" an object or "with a member on each side" of an object. For example and without limitation, the disclosed forked bit 40 includes a first fork member 54 on one side of an elongated deformable portion 42 and an opposite second fork member 56 on the opposite second side of the elongated deformable portion 42. Hence, the example forked bit 40 straddles the portion 42.

The invention is described in association with a single-pole circuit breaker including a thermal-magnetic trip assembly, although the invention is applicable to a wide range of circuit interrupters including any number of poles and at least a thermal trip assembly.

Figure 1:
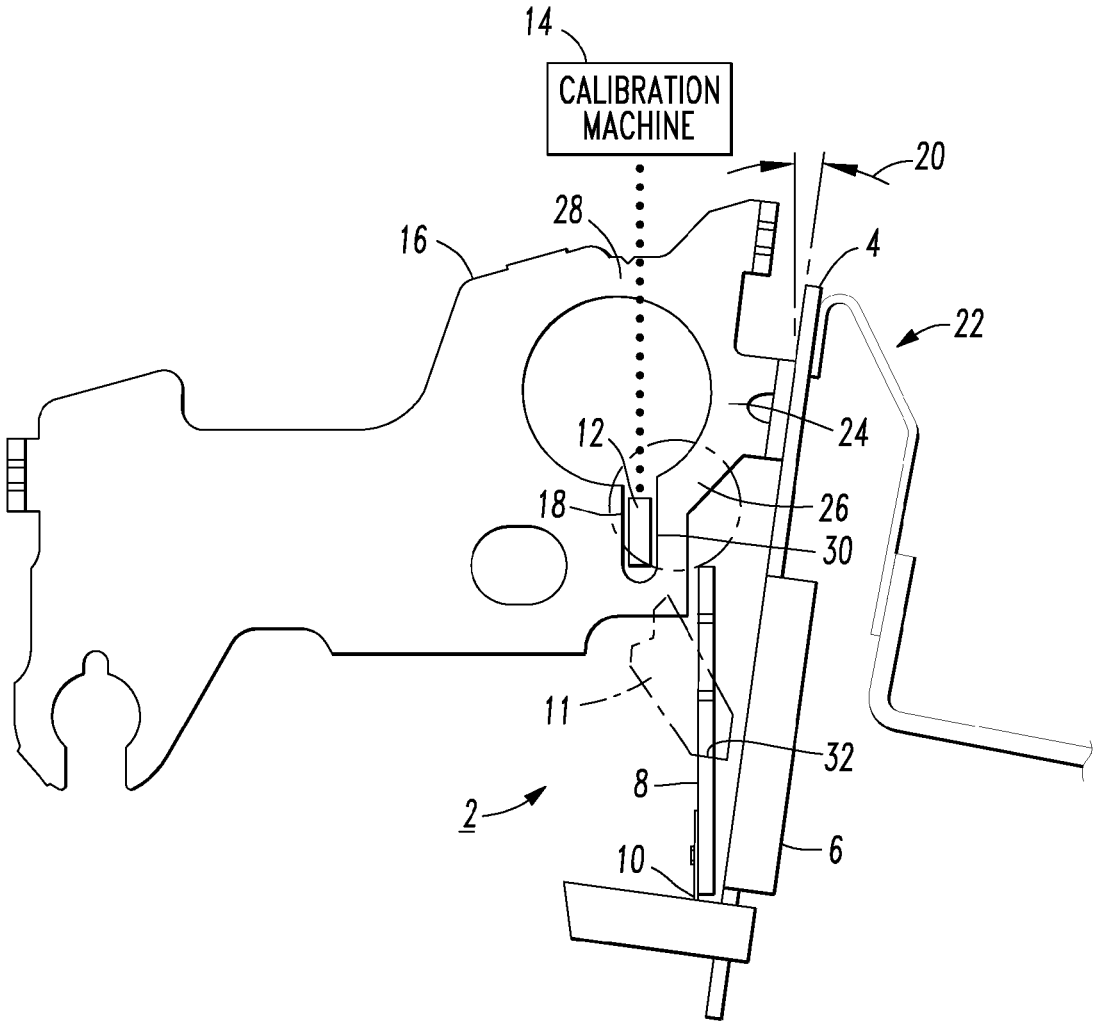
FIG. 1 is a simplified vertical elevation view of a circuit breaker frame and thermal-magnetic trip assembly before thermal calibration.
Figure 2:
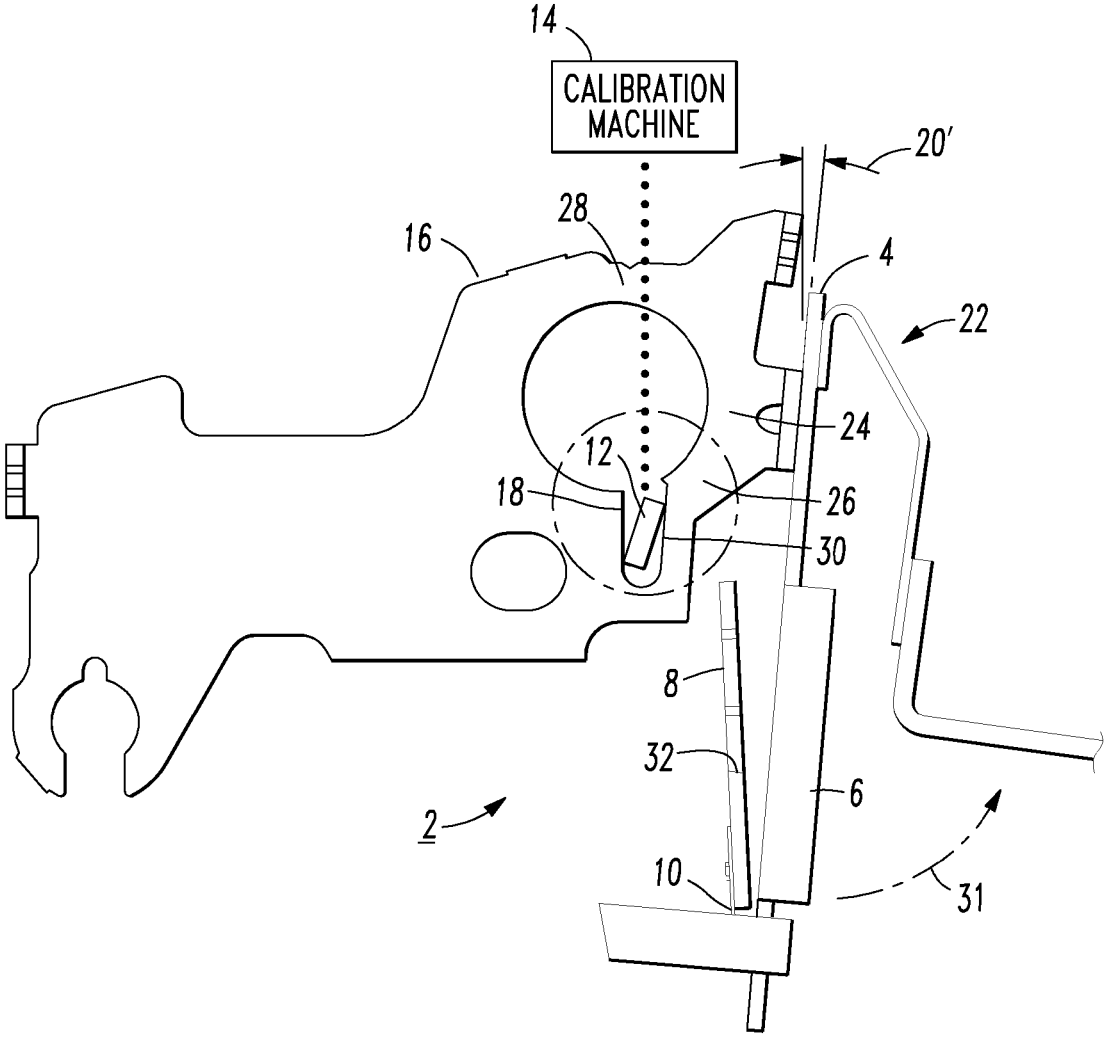
FIG. 2 is a simplified vertical elevation view of the circuit breaker frame and thermal-magnetic trip assembly of FIG. 1 after thermal calibration.
Figure 3:
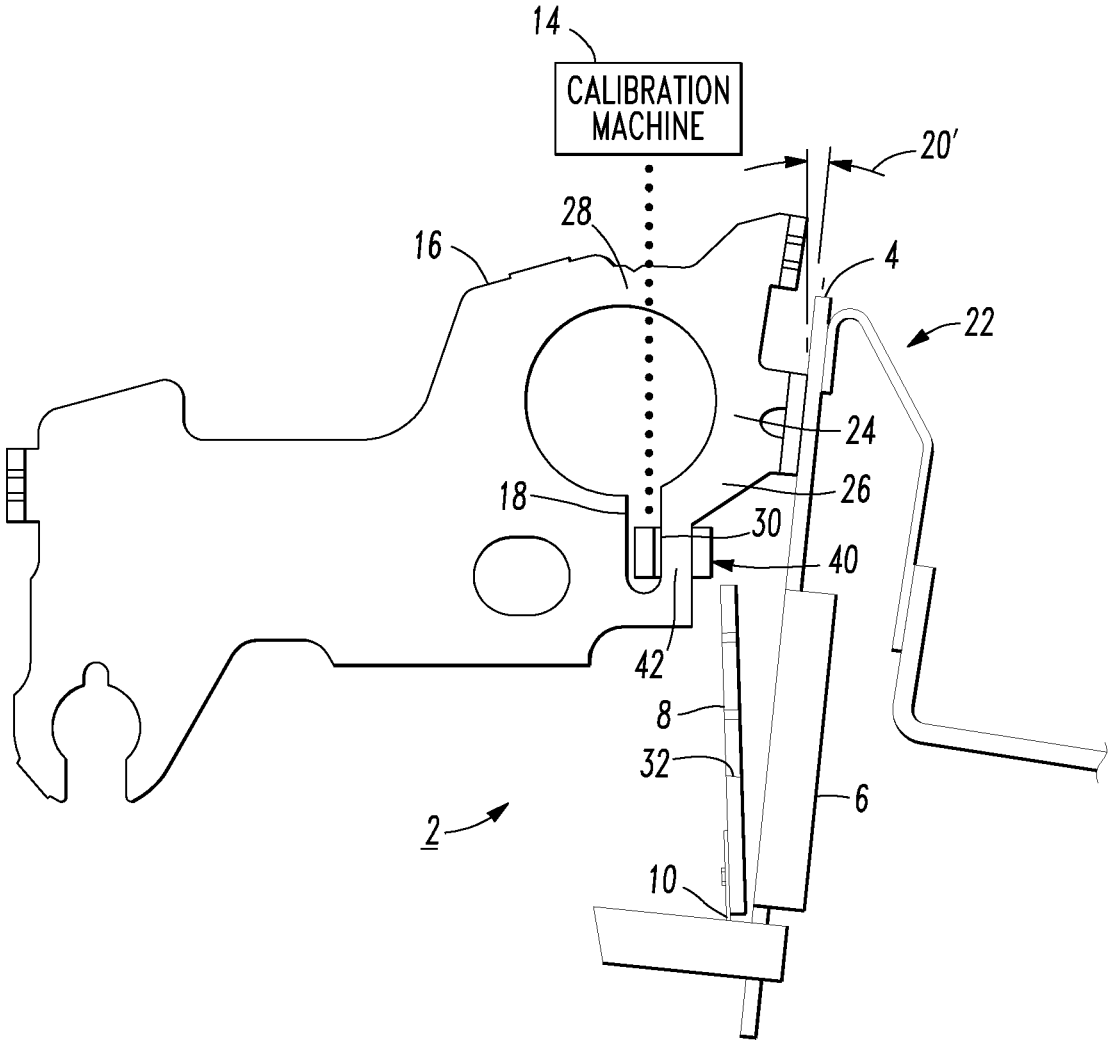
FIG. 3 is a simplified vertical elevation view of a circuit breaker frame and thermal-magnetic trip assembly before thermal calibration or before thermal re-calibration in accordance with an embodiment of the invention.
Figure 4:
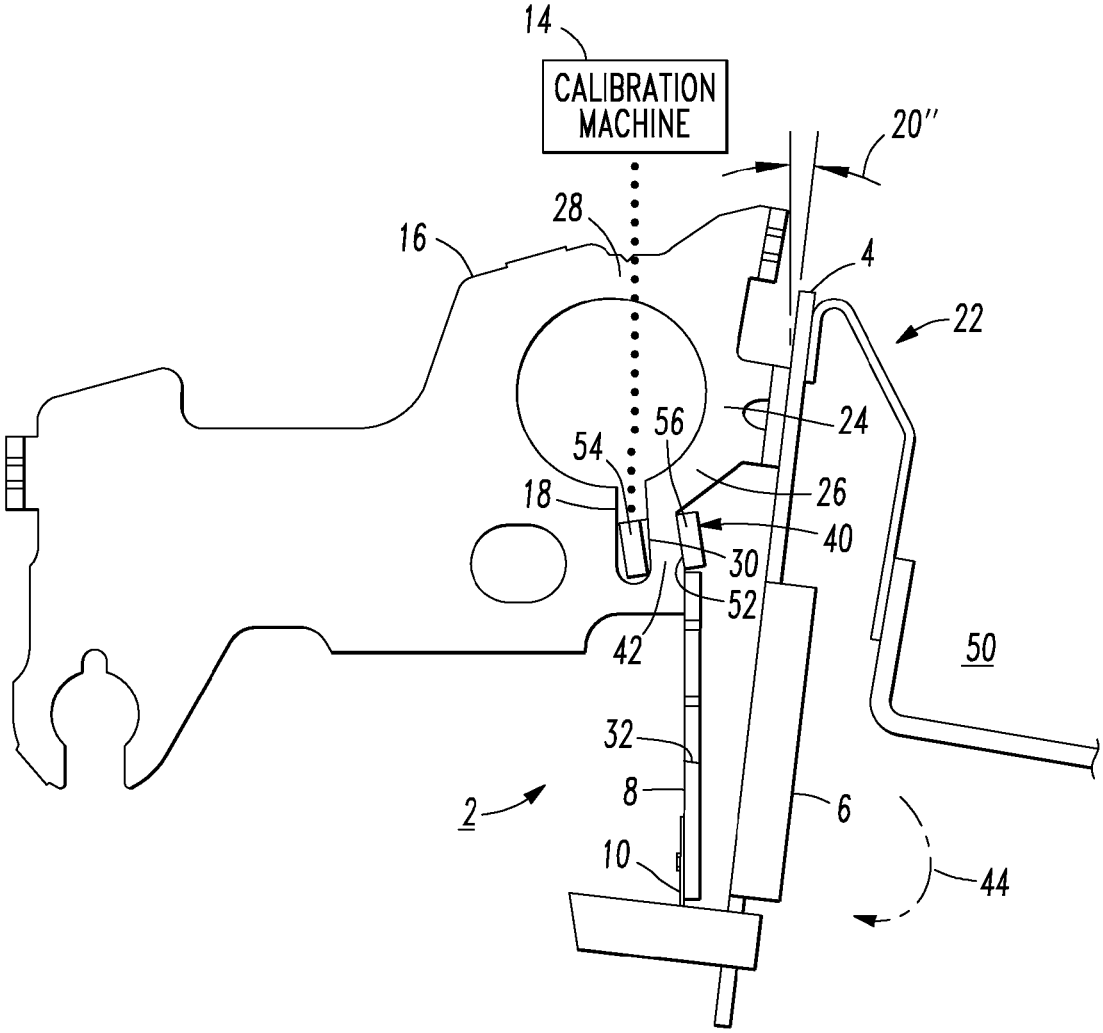
FIG. 4 is a simplified vertical elevation view of the circuit breaker frame and thermal-magnetic trip assembly of FIG. 3 after thermal calibration or after thermal re-calibration.

As shown in FIGS. 3 and 4, the circuit breaker 2 of FIGS. 1 and 2 is employed. A suitable tool (e.g., without limitation, a forked calibration bit 40 (as contrasted with the flat bit 12 of FIGS. 1 and 2)) straddles the deformable portion 42 of the deformable steel frame 16. This allows for clockwise (as in FIG. 2) and counterclockwise (with respect to FIG. 4) rotation and the resulting corresponding deformations of the deformable steel frame 16, as will be described.

FIG. 3 shows the circuit breaker frame 16 either before the initial calibration or before a subsequent re-calibration (as in FIG. 4) in which the forked calibration bit 40 deforms the deformable steel frame 16 in the counterclockwise (with respect to FIG. 4) direction as will be discussed. FIG. 4 shows the circuit breaker frame 16 either after initial calibration or after subsequent re-calibration. In either case, the forked calibration bit 40 has deformed the deformable steel frame 16 by rotating in the counterclockwise direction.

It will be appreciated that clockwise rotation (with respect to FIG. 3) of the forked calibration bit 40 gives the same result as that of the flat calibration bit 12 of FIG. 2. However, in contrast, by rotating the forked bit 40 of FIGS. 3 and 4 in the opposite counterclockwise direction (with respect to FIG. 4), this deforms the frame 16 such that a circuit breaker, such as 2, which previously calibrated below the low limit of the desired calibration range, could be re-calibrated to bring it back within the desired calibration range. Hence, the bimetal 4 is effectively rotated in the clockwise direction (with respect to FIG. 4), which then requires relatively more travel (i.e., more heat) of the bimetal assembly 22 to achieve a thermal tripping condition.

As a result of the frame deformation, the angle 20" (FIG. 4) of the bimetal assembly 22 is increased with respect to the angle 20' of FIG. 3, which raises the thermal calibration of the circuit breaker 2. Counterclockwise rotation of the forked bit 40 (with respect to FIG. 4) deforms the upper right portion 24 of the frame 16 to the right (with respect to FIG. 4), pivots the bimetal 4 (and the armature 8) in the opposite clockwise direction 44 (with respect to FIG. 4), and causes the circuit breaker 2 to trip at relatively higher bimetal temperatures (raises the $I^2R$ thermal calibration of the circuit breaker 2).

Rotating the forked calibration bit 40 in one or both directions and deforming the frame 16 in two opposite manners eliminates fall-out of certain circuit breakers after re-check, which would otherwise result from such circuit breakers being below the low end of the desired calibration range with no re-calibration being possible (as in FIG. 2). This permits re-calibration (i.e., by raising the thermal calibration level) after a re-check of the circuit breaker 2 might show it to be below the "low side" of the desired thermal calibration range. This reduces and may eliminate scrap and/or rework of circuit breakers. Hence, if a circuit breaker is below the low calibration limit, then the direction of frame calibration is simply reversed (FIG. 4) by the forked calibration bit 40, in order to bring such circuit breaker back above the low calibration limit and within the desired calibration range.

FIG. 4 shows a circuit interrupter test system 50, which includes a suitable calibration device, such as the calibration machine 14, the forked bit 40, and a circuit interrupter under test, such as the example circuit breaker 2. The calibration machine 14 preferably applies a predetermined line voltage and a predetermined load to the circuit breaker 2, and measures the time of the thermal trip response. In turn, based upon the desired calibration range, the calibration machine 14 causes the forked bit 40 to rotate in the proper rotational direction (e.g., counterclockwise as shown in FIG. 4) by a proper angular amount, in order to bring the circuit breaker 2 within the desired calibration range (e.g., back above the low calibration limit).

The elongated deformable portion 42 of the circuit breaker 2 includes a first side, which is the right side 30 of the slot 18, and an opposite second side 52. The forked bit 40 includes a first fork member 54 adjacent the right side 30 of the slot 18 and an opposite second fork member 56 adjacent the opposite second side 52 of the elongated deformable portion 42. The second side 52 of the elongated deformable portion 42 is an outer edge of the deformable frame 16. The elongated deformable portion 42 is between the elongated slot 18 and that outer edge 52. The first fork member 54 is in the elongated slot 18 and the opposite second fork member 56 is adjacent the outer edge 52.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of thermally calibrating a circuit interrupter, said method comprising:

employing a circuit interrupter under test;

including with said circuit interrupter under test a deformable frame having an elongated slot, an elongated deformable portion adjacent the elongated slot and a movable portion adjacent the elongated deformable portion;

coupling a thermal trip assembly to the movable portion of said deformable frame;

employing said thermal trip assembly having a first thermal response;

straddling the elongated deformable portion of said deformable frame with a tool;

rotating said tool in a first rotational direction and responsively deforming said elongated deformable portion and moving the movable portion of said deformable frame in a first direction, in order to calibrate said thermal trip assembly for a second thermal response, which is different than said first thermal response; and rotating said tool in a second rotational direction, which is opposite said first rotational direction, and responsively deforming said elongated deformable portion and moving the movable portion of said deformable frame in a second direction, which is opposite said first direction, in order to re-calibrate said thermal trip assembly for a third thermal response, which is between said first and second thermal responses.

2. The method of claim 1 further comprising including with said elongated deformable portion a first side and an opposite second side; and employing as said tool a forked bit having a first fork member adjacent the first side of said elongated deformable portion and an opposite second fork member adjacent the opposite second side of said elongated deformable portion.

3. The method of claim 2 further comprising employing as the opposite second side of said elongated deformable portion an outer edge of said deformable frame;

disposing said elongated deformable portion between said elongated slot and said outer edge;

disposing the first fork member in said elongated slot; and disposing the opposite second fork member adjacent the outer edge of said deformable frame.

4. The method of claim 1 further comprising employing said third thermal response being less than said first thermal response and greater than said second thermal response.

5. The method of claim 1 further comprising responsive to said rotating said tool in the second rotational direction, deforming said elongated deformable portion generally in said first direction and moving said movable portion in the opposite second direction.

6. The method of claim 1 further comprising employing said second thermal response being less than said first thermal response.

7. The method of claim 1 further comprising rotating said tool with a calibration apparatus.

8. The method of claim 1 further comprising employing as said deformable frame a deformable steel frame.

9. The method of claim 1 further comprising employing as said circuit interrupter a circuit breaker.

10. The method of claim 1 further comprising including a bimetal with said thermal trip assembly.

11. A circuit interrupter test system comprising:

a circuit interrupter under test, said circuit interrupter under test comprising:

a deformable frame including an elongated slot, an elongated deformable portion adjacent the elongated slot and a movable portion adjacent the elongated deformable portion, and a thermal trip assembly coupled to the movable portion of said deformable frame; and a calibration device comprising:

a tool straddling the elongated deformable portion of said deformable frame, wherein said thermal trip assembly has a first thermal response, wherein said calibration device is structured to rotate said tool in a first rotational direction and responsively deform said elongated deformable portion and move the movable portion of said deformable frame in a first direction, in order to calibrate said thermal trip assembly for a second thermal response, which is different than said first thermal response, and wherein said calibration device is structured to rotate said tool in a second rotational direction, which is opposite said first rotational direction, and responsively deform said elongated deformable portion and move the movable portion of said deformable frame in a second direction, which is opposite said first direction, in order to re-calibrate said thermal trip assembly for a third thermal response, which is between said first and second thermal responses.

12. The circuit interrupter test system of claim 11 wherein said elongated deformable portion includes a first side and an opposite second side; and wherein said tool includes a forked bit having a first fork member adjacent the first side of said elongated deformable portion and an opposite second fork member adjacent the opposite second side of said elongated deformable portion.

13. The circuit interrupter test system of claim 11 wherein the opposite second side of said elongated deformable portion is an outer edge; wherein said elongated deformable portion is between said elongated slot and said outer edge; wherein the first fork member is in said elongated slot; and wherein the opposite second fork member is adjacent said outer edge.

14. The circuit interrupter test system of claim 11 wherein said third thermal response is less than said first thermal response and greater than said second thermal response.

15. The circuit interrupter test system of claim 11 wherein responsive to said calibration device rotating said tool in the second rotational direction, said elongated deformable portion deforms generally in said first direction and moves said movable portion in the opposite second direction.

16. The circuit interrupter test system of claim 11 wherein said second thermal response is less than said first thermal response.

17. The circuit interrupter test system of claim 11 wherein said calibration device further comprises a calibration apparatus structured to rotate said tool.

18. The circuit interrupter test system of claim 11 wherein said deformable frame is a deformable steel frame.

19. The circuit interrupter test system of claim 11 wherein said circuit interrupter is a circuit breaker.

20. The circuit interrupter test system of claim 11 wherein the opposite second side of said elongated deformable portion is an outer edge; wherein said thermal trip assembly comprises a bimetal disposed at a first angle for said first thermal response; wherein said second thermal response corresponds to a second angle, which is less than said first angle; and wherein said third thermal response corresponds to a third angle, which is less than said first angle and greater than said second angle.

21. The circuit interrupter test system of claim 20 wherein said first angle is about 8.7°.

* * * * *